United States Patent [19]

Harris

[11] Patent Number: 5,016,318

[45] Date of Patent: May 21, 1991

[54] MULTI-DIRECTIONAL RADIAL WHEEL TROLLEY AND TRACK FOR OPERABLE WALLS

[75] Inventor: Donald L. Harris, Key Largo, Fla.

[73] Assignee: Panelfold, Inc., Miami, Fla.

[21] Appl. No.: 379,186

[22] Filed: Jul. 13, 1989

[51] Int. Cl.[5] ..... E05D 16/26

[52] U.S. Cl. ..... 16/95 R; 16/94 R; 160/206; 49/127; 49/130

[58] Field of Search ..... 16/95 R, 87 R, 89, 90, 16/96 R, 94 R; 160/196.1, 37, 40, 206; 104/130, 132; 49/127, 128, 130, 125

[56] References Cited

U.S. PATENT DOCUMENTS

| | | | |
|---|---|---|---|
| 1,889,112 | 11/1932 | Shoemaker | 16/96 R |
| 2,937,398 | 5/1960 | Latham | 16/95 R |
| 3,491,400 | 1/1970 | Hubbard | 160/206 |
| 3,708,916 | 1/1973 | Karp | 16/97 |
| 4,141,106 | 2/1979 | Dixon | 16/89 |
| 4,159,556 | 7/1979 | Dickson | 16/94 R |
| 4,569,164 | 2/1986 | Dickson | 49/130 |

FOREIGN PATENT DOCUMENTS

| | | | |
|---|---|---|---|
| 2404875 | 8/1975 | Fed. Rep. of Germany | 49/127 |

*Primary Examiner*—Kurt Rowan
*Assistant Examiner*—James Miner
*Attorney, Agent, or Firm*—Fleit, Jacobson, Cohn, Price, Holman & Stern

[57] ABSTRACT

A multi-directional track and trolley system for movably supporting wall panels in which the track includes spaced track flanges forming a track slot and at least one track intersection having a curved track element with a curved edge and the trolley includes radial support wheels rotatably mounted in laterally spaced tandem pairs on a plate, frame or rigid trolley body for rotation about spaced parallel horizontal axes. The trolley is provided with guide rollers adjacent each end thereof and a centrally disposed panel supporting member which depend from the trolley body and are positioned in the track slot with the guide rollers mounted for rotation about generally vertical axes to guide the trolley. The diameter of and distance between the guide rollers, the radius of the curved edge of the track intersection and the diameter of the supporting member are related to prevent the supporting member from coming into contact with the curved edge of the track intersection when the trolley moves through the track intersection whereby the trolley entering the intersection from one direction can exit from the intersection in any of at least two directions without stopping while changing its direction of travel. To combine the multi-directional track and trolley system with a preprogrammed system, diverter pins are provided on the trolley and are associated with diverter blades at diverter intersections to assure that the trolleys and thus the wall panels will always follow the same route through the diverter intersections.

27 Claims, 4 Drawing Sheets

FIG. 1
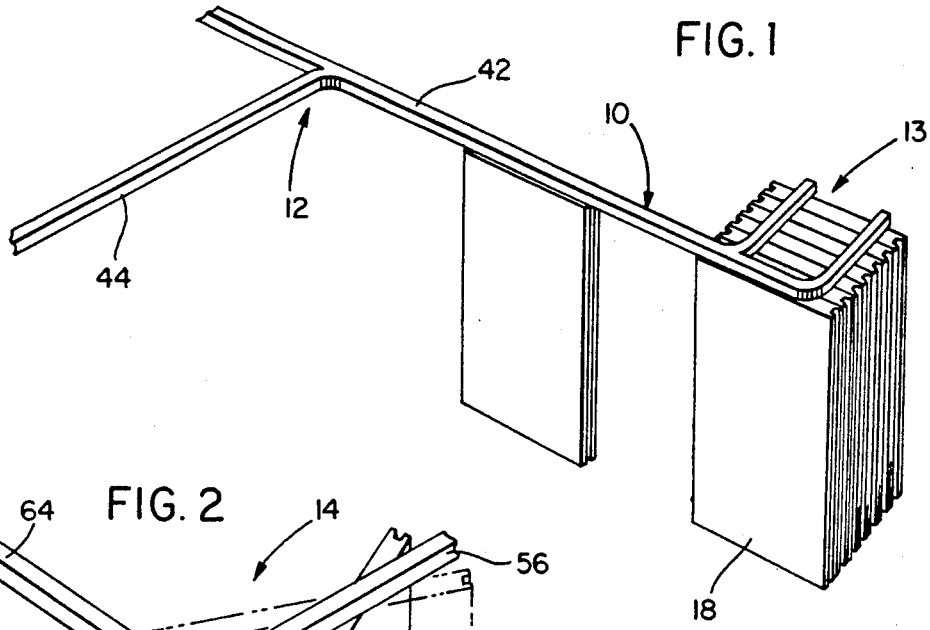
FIG. 2
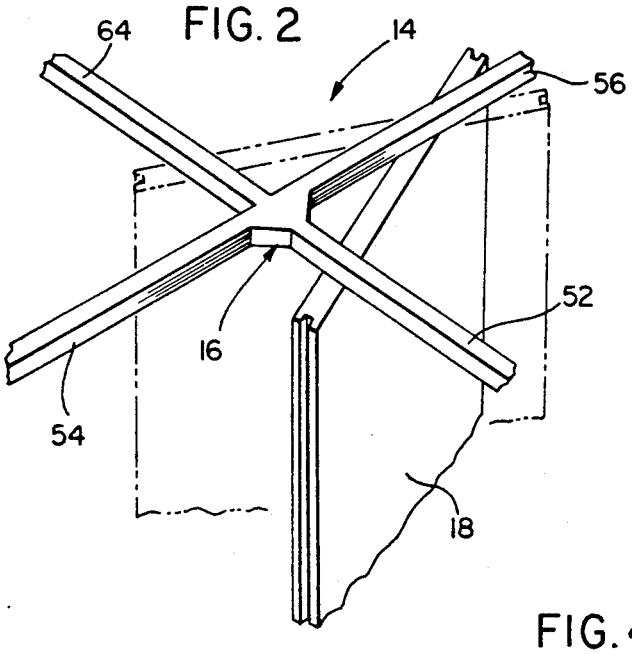
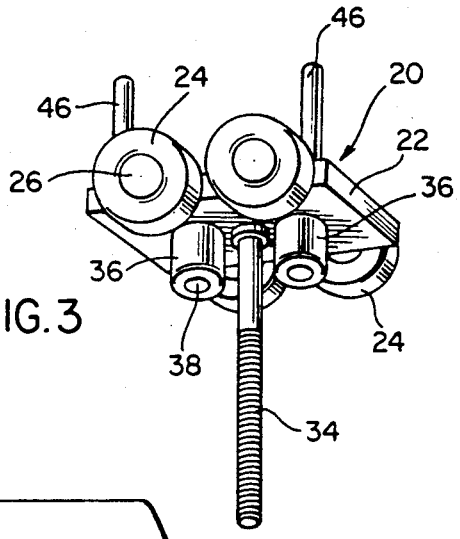
FIG. 3
FIG. 4
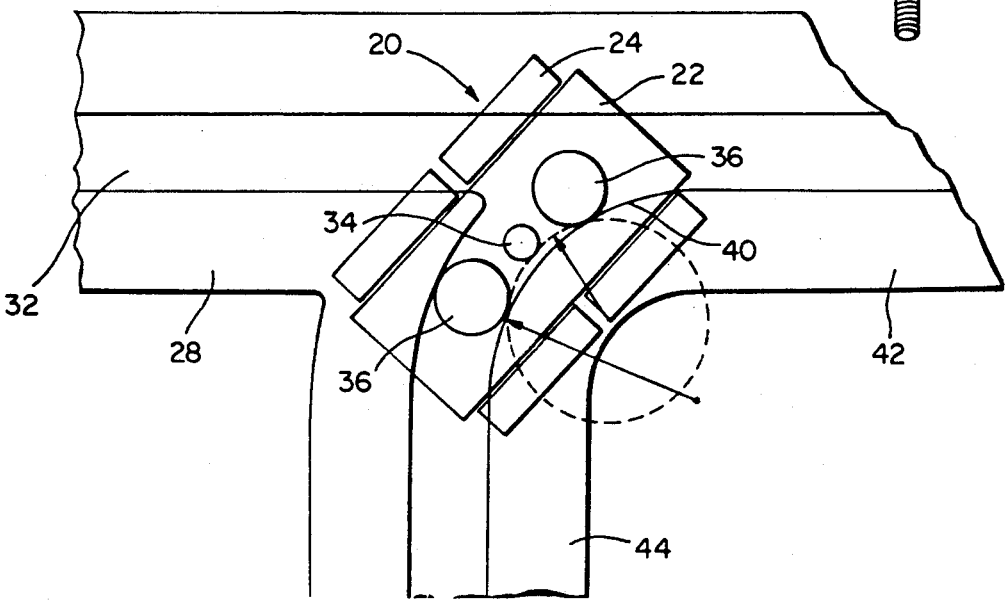

MULTI-DIRECTIONAL RADIAL WHEEL TROLLEY AND TRACK FOR OPERABLE WALLS

BACKGROUND OF THE INVENTION

FIELD OF THE INVENTION

The present invention generally relates to a multi-directional radial wheel track and trolley system for operable walls in which the trolley includes radial support wheels rotatable in the same direction about horizontal axes and supported from a plate, frame or the like in which the radial wheels are arranged in laterally spaced tandem pairs. The trolley is provided with guide rollers adjacent each end thereof which depend from the plate and are positioned in the track slot and mounted for rotation about generally vertical axes to guide the trolley with the guide rollers and curvature of the track slot being dimensioned to prevent contact between the edge of the track slot and a depending supporting bolt for the wall panel when the trolley moves through a track intersection having a curved element. By imparting a manual lateral force to a moving wall panel, the trolleys and thus the wall panel may be selectively moved through the track intersection in multiple directions without stopping at the intersection. Optional diverter pins may be provided on the trolley for association with optional diverter blades at certain track intersections so that at such intersections the trolleys and thus the wall panels will move in a preprogrammed path.

INFORMATION DISCLOSURE STATEMENT

Many trolley and track systems have been utilized to movably support operable wall panels or partitions. One such arrangement is disclosed in U.S. Pat. No. 4,141,106, issued Feb. 27, 1979, which includes various arrangements in which a canted wheel or canted wheels are provided on the trolley which enables the trolleys and panels to move in multi-directions through an intersection by exerting lateral pressure on the panel and trolleys to cause the trolleys and panel to move in a selected direction at an intersection in the track. U.S. Pat. No. 3,879,799, issued Apr. 29, 1975, discloses a multi-directional support for movable partitions in which the carrier or trolley includes rollers which rotate about a vertical axis.

U.S. Pat. No. 1,889,112 issued Nov. 19, 1932 discloses an early development in this type of trolley and track system in which four radial wheels are provided on the trolley for multi-directional movement through a track intersection in which the rotational axes of the wheels are in perpendicular relation to each other. In this construction, all four wheels will drop into the track slots at the intersection thus causing the supported panel to drop vertically and become stuck. Such a structure does not work satisfactorily with operable walls having panels that may weigh anywhere from 500 to 2000 lbs. U.S. Pat. No. 3,708,916 discloses a similar structure in which the problem of the panel dropping when the wheels register with the track slot at an intersection has been recognized and arcuate plates have been added to the trolley to reduce the distance that the wheels drop into the track slot when they pass through an intersection. Even with the plates, the wheels still will drop partially into the track slots and the panels still become stuck. Also, as illustrated in FIG. 10 of that patent, the trolleys cannot rotate in relation to the panel thereby orienting the axes of rotation of the radial wheels in angular relation to the track flanges during movement of the trolleys through the broken line position causing frictional drag and requiring greater force necessary to move the panels.

Another type of trolley and track system utilizes spherical balls to support the trolley for movement along a track. U.S Pat. Nos. 3,181,274 and 3,253,552 disclose such arrangements. However, the supporting balls and their close fitting sockets quickly become clogged with dirt which prevents rotation of the balls. This results in the balls wearing or grinding out grooves in the track flanges especially when used with an aluminum track with the trolleys being difficult to move along the track and not capable of movably supporting heavy panels without great physical effort. In addition, U.S. Pat. Nos. 3,462,792 issued Aug. 26, 1969 and 4,159,556 issued July 3, 1979 disclose additional trolley arrangements supported from track flanges by spherical balls with U.S. Pat. No. 4,159,556 disclosing the use of upwardly facing spherical bearings located adjacent the junction or intersection in the track to engage and support the trolley as the trolley is moved across the junction in an effort to prevent the balls from dropping into the track slot at track intersections.

Another type of trolley and track system is disclosed in U.S. Pat. No. 3,557,499 which utilizes a circular disc or puck mounted on the upper end of a pendant bolt with the axial lower surface of the disc or puck sliding along the upper surface of the track flanges.

German Pat. No. 2,145,793 discloses several embodiments of a trolley with radial wheels having rotational axes in perpendicular relation to each other. In the arrangement illustrated in FIGS. 1 and 2, four balls are supported from the trolley to support the trolley when the radial wheels cross an intersection which arrangement still permits the trolley to drop a short vertical distance when the wheels drop into the track slot which then causes the periphery of the balls to support the trolley from the track flanges. Each trolley requires eight supporting bearings which is a costly structure. In FIGS. 3 and 4, four pads are provided in lieu of balls to function to limit the vertical drop of the radial wheels when crossing an intersection. In both arrangements, the trolley can unintentionally rotate at the track intersection causing the rotational axes to be angled in relation to the track slot rather than perpendicular or parallel to the track slot thereby causing dragging friction. In FIGS. 5 and 6, an auxiliary arrangement of radial wheels is provided supported by a laterally extending arm connected with the pendant bolt. In FIGS. 7 and 8, pins 25 are used to keep the trolley from unintentionally rotating at the track intersection but in this construction when the two trolleys of a panel simultaneously traverse two intersections, the pins and guide slots do not operate satisfactorily causing the trolleys to become stuck and the embodiment of this type of structure which is being manufactured now utilizes a ball-type arrangement somewhat similar to that disclosed in U.S. Pat. No. 4,159,556. German Pat. No. 2,159,539 discloses a four wheel trolley having the axes in perpendicular relation together with a puck arrangement positioned above the trolley and engaging auxiliary flanges to limit the vertical downward movement of the trolley when the wheels cross a track slot.

The prior art discloses many different types of multi-directional trolley and track systems for supporting wall panels and the like which enable an operator to select the direction of movement through an intersection in the track. The prior art includes slide discs, canted rotatable wheels, wheels rotatable about vertical axes, spherical ball arrangements and radial wheel arrangements, all of which have some of the disadvantages and shortcomings as discussed above. Further, all the prior art multi-directional trolleys require that the trolley come to a dead stop at the intersection prior to a change in direction of trolley movement, thereby causing a loss of momentum in the panels travel as well as inconvenience, loss of time and extra effort by the operator.

Also, there are track and trolley systems commercialized that include dynamic, i.e., switchable track intersections, commonly referred to as track switches, usually electrically operated, that are used with radial wheel trolleys for high load capabilities and which allow the operator to select the direction of travel of the trolley through the switch. In some designs the entire switch assembly rolls back and forth along a system of carriages with the switch being moved by pistons. Such switches are of complex and expensive construction, require wiring the switch to a building power source and control wiring to a remote control switch. The control switches are usually locked key controls and operated only by qualified building maintenance personnel. The key control is often located a long distance from the track switch especially where multiple track switches are in a room thereby requiring coordination between a person moving the panels and another person operating the key control or lengthy setup time to travel between the key control and the panels particularly when some trolleys are required to move in one direction and other trolleys in another direction through the track switch. A complex track system, for example to divide a large assembly room into many smaller meeting rooms using operable wall panels, may require a track layout incorporating numerous track intersections with different panels moving through each intersection in different directions. In such an arrangement the cost, complexity and operational inconvenience of track switches can be considerable.

Also, commercialized is a preprogrammed track system incorporating diverter intersections and diverter trolleys in which each panel will be directed along a single predetermined path to form a wall or partition with this type of system requiring less operator skill since interacting guide arrangements are provided on the trolleys and tracks at the intersections to make certain that each trolley will move in a predetermined direction through each intersection. This system has all of the high load bearing and free rolling advantages of radial wheels but lacks the ability for a trolley to be selectively directed at certain intersections.

Also known are track systems incorporating a combination of track diverters and track switches whereby respective trolleys move through the track diverters in a preprogrammed manner but can be selectively directed at the track switches upon electromechanically switching each switch, with the attendant costs and inconvenience of track switches as enumerated above.

Nowhere in the prior art or commercial practice are there known trolley and track systems for operable walls incorporating static (i.e., non-switchable) track intersections at which it is possible for a trolley upon entering the intersection from at least one direction to be selectively caused to exit the intersection in any of two or more directions without the inconvenience of stopping to align the trolley with the intersecting track and to change the direction of the trolley's travel.

SUMMARY OF THE INVENTION

An object of the present invention is to provide a multidirectional trolley and track for operable walls in which the trolley utilizes four radial wheels all of which are oriented in the same direction resulting in high load carrying capacity, ease of operation, better tracking along the track flanges and no dropping of the wheels as they cross a track intersection inasmuch as three of the four wheels will always carry the load at an intersection thereby providing a steady level support which does not teeter-totter as it crosses a track intersection. The positions and diameter of the guide rollers in relation to the position and diameter of the support bolt and the radius of curvature of the curved track flange edge cooperate to enable the operator to selectively effect a change of direction in trolley and panel movement without stopping the motion of the trolley and panel. As a trolley arrives at the track intersection, it is only necessary to impart lateral force sufficient to hold the lead guide roller against the curved track flange edge until the lead guide roller has entered the track slot of the connecting track. This initiating lateral manual force rotates the trolley approximately 30° and thereafter the guide rollers and track slot automatically rotate the trolley the remainder of the turn. In the case of a 90° turn, the approximately 30° initial manual rotation accounts for approximately $\frac{1}{3}$ of the turn while the automatic rotation accounts for approximately 60° or $\frac{2}{3}$ of the turn. This enables the operator to exert lateral force to the trolley as it approaches an intersection and eliminates the necessity of slowing and stopping the trolley to align it with an intersecting branch track slot which is necessary when the track slots are connected by a 90° sharp angled corner. This greatly reduces the time and effort required to effectively move the trolleys and supported panels.

A further object of the invention is to provide a track and trolley system in accordance with the preceding object which enables a trolley entering an intersection from at least one direction to exit from that intersection in any of at least two directions without stopping while changing the direction of travel.

Another object of the invention is to provide a track and trolley system in accordance with the preceding objects in which the four radial wheel trolleys which have forward and rear guide rollers mounted centrally thereon to engage the track slot will be engaged with the track slot edge when side pressure is exerted on the panel and trolley to facilitate use of the trolleys in a multi-directional track system even though the trolley may have diverter pins mounted thereon with the pins being ineffective when the intersection is not provided with diverter blades.

Yet another feature of the invention is to provide a track and trolley system in accordance with the preceding objects including a T-type intersection having a curved track element engaged by guide rollers on the trolley body.

Still another significant feature of the invention is to provide a track and trolley system in accordance with the preceding objects including a 4-way or X-type intersection or a 3-way or Y-type intersection having a double 45° curve in one direction and a 90° curve in the opposite direction and located at different points along the track with the oppositely extending track sections in parallel and aligned relation to each other to preclude the trolley wheels from dropping at an intersection inasmuch as three of the wheels will be continuously engaged with the track flanges.

Still another object of the present invention is to provide a combined multi-directional track and trolley system in which the trolley is provided with four radial wheels rotatable about horizontal axes and the track is provided with intersections incorporating curved elements with the trolley including longitudinally spaced guide rollers received in the track slot and dimensioned and spaced in relation to a centrally disposed depending support bolt to maintain the support bolt positioned in spaced relation to the slot edges.

A still further object of the invention is to provide a track and trolley system as set forth in the preceding objects in which certain of the intersections are optionally provided with diverter blades and the trolleys are provided optionally with diverter pins having selected locations and lengths cooperating with the diverter blades to preprogram the movement of the panels through the intersection thereby enabling both multi-directional intersections and preprogrammed intersections thereby combining multi-directional movement of the panels and preprogrammed directional movement of the panels in the same track system to enhance the versatility of installation and use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic perspective view illustrating a trolley and track system of the present invention with a curved track intersection and stacking area being illustrated.

FIG. 2 is a schematic perspective view illustrating a 4-way or X-type intersection.

FIG. 3 is a perspective view of the trolley employed in this invention.

FIG. 4 is a schematic plan view of the trolley and track illustrating the curved track slot edges and the relationship of the radial wheels, guide rollers and supporting bolt for the panel.

DESCRIPTION OF THE PREFERRED EMBODIMENTS

Figure 5A:
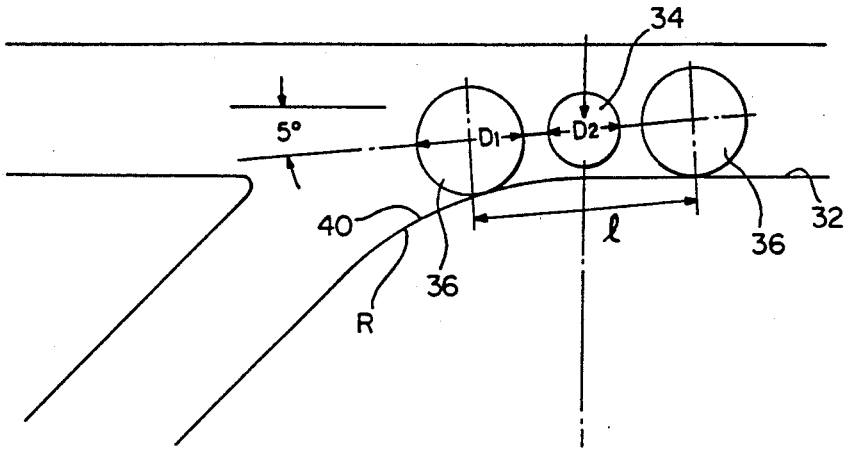
FIG. 5*a* is a schematic plan view illustrating a side force on a panel and the relationship of the components of the trolley and track of this invention.

Referring now specifically to the drawings, the track and trolley system of the present invention as illustrated in FIG. 1 is generally designated by reference numeral 10 in which the track includes a T-intersection 12 and a stacking ar ®a 13 incorporating another T-intersection as well as a simple curve. FIG. 2 illustrates the track and trolley system of the invention designated by reference numeral 14 in which a 4-way or X-intersection 16 is disclosed. Various types of intersections normally provided in a track system may be employed with the invention to enable suspended wall modules or panels 18 to be moved along the track system with trolleys 20 supporting the panels.

As illustrated in FIG. 3, each trolley 20 includes a generally rectangular plate, frame or other rigid body 22 journalling four radial wheels 24 with the wheels being rotatable about horizontal axles or pins 26 with two of the wheels oriented at each side of the rigid rectangular plate 22 with the periphery of the radial wheels 24 supportingly engaging the horizontal track flanges 28 forming a portion of the downwardly facing, inverted channelshaped track 30 with the wheels 24 being spaced to engage the flanges 28 adjacent the edges of the track slot 32. Centrally of the rigid trolley plate 22 is a depending pendant bolt 34 which supports the panel 18 in a well-known and conventional manner.

Located adjacent the front and rear of the trolley plate 22 and depending from the center line thereof is a pair of guide rollers 36 which rotate about vertical axles or pins 38 with the guide rollers 36 having an outside diameter substantially the sam but slightly less than the width of the track slot 32 as illustrated in FIG. 4. Also as illustrated in FIG. 4, the guide rollers 36 engage the curved edge 40 of the T-intersection 12 when lateral force is exerted on the panel to cause the trolley 20 to move from the straight track segment 42 onto the branch track segment 44. The diameter of and distance between the rollers 36, the radius of the curved edge 40 of the intersection and the diameter of the supporting pendant bolt 34 are related in a manner to prevent the pendant bolt 34 from coming into contact with the curved edge 40 of the track intersection. Therefore, side force results in the lead and trail guide rollers of the trolley following the track edge it is forced against as illustrated in FIG. 5a thereby causing the trolley to change its direction of travel and to rotate a corresponding amount so that the trolley wheels 24 always rollingly engage the track flanges.

Figure 5B:
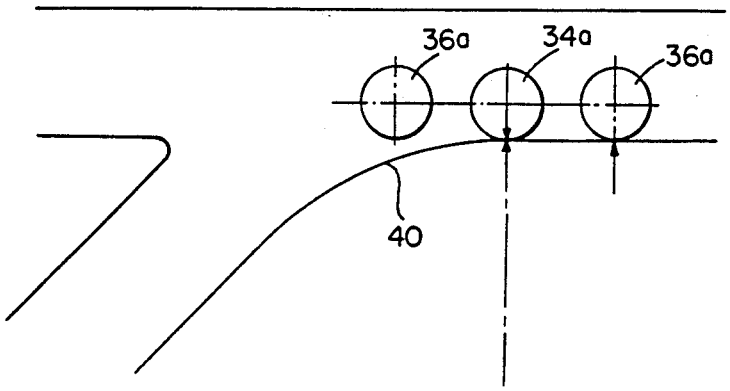
FIG. 5*b* is a schematic plan view illustrating a comparative trolley in which the guide rollers and supporting bolt are of equal diameter.

FIGS. 5a and 5b illustrate this relationship and the results of a side force being exerted on a panel. The dimensional characteristics of these components -are approximated by the formula:

$$r \geqq \frac{(D_1 - D_2)^2 + l^2}{4(D_1 - D_2)}$$

with r = Radius of track curvature $D_1$ = Diameter of guide rollers $D_2$ = Diameter of pendant bolt l = Distance between centers of guide rollers As illustrated in FIG. 5a, when a side force is applied to the panel, the guide rollers follow the curved edge 40 during the turn cycle. However, if the rollers and pendant bolt were the same diameter, as shown in FIG. 5b, the pendant bolt would engage the track flanges and cause the lead guide roller to tend to move in a generally straight line toward the opposite point of the intersection and prevent the trolley from rolling through the directional change.

Figure 6:
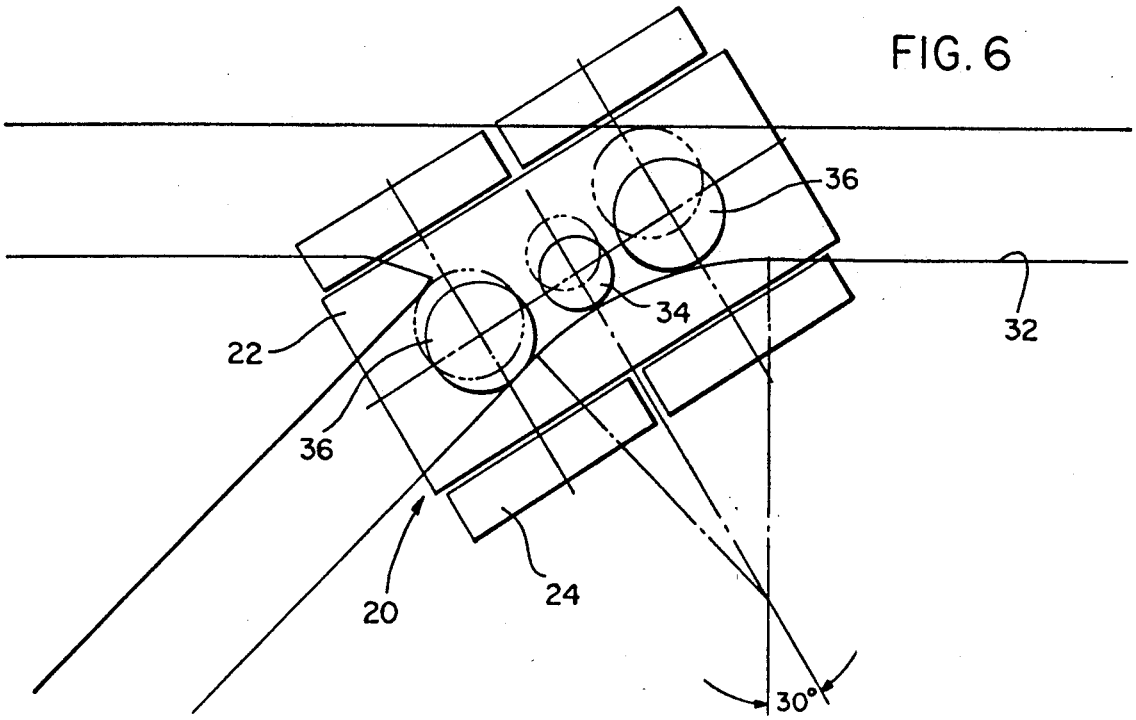
FIG. 6 is a schematic plan view illustrating the manual turn angle and automatic turn angle of the trolley during a turn cycle.

FIG. 6 schematically illustrates the application of lateral manual force being applied to the panel to rotate and change direction of the trolley for approximately 30° of a turn after which the trolley automatically rotates and changes direction for the remainder of the turn.

Figure 7:
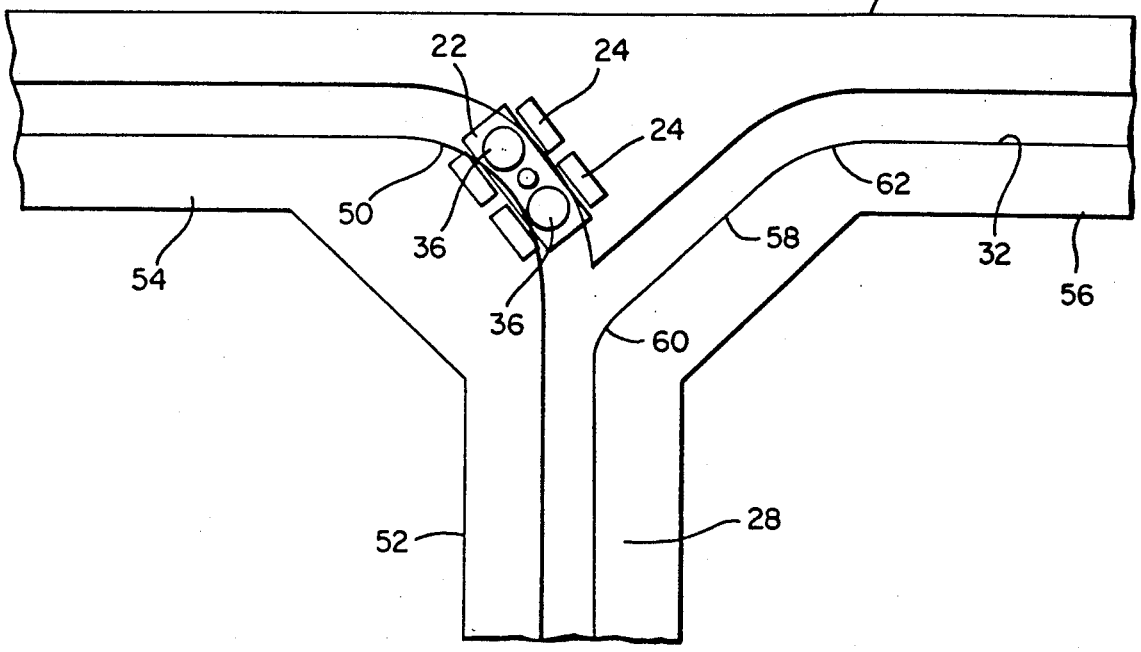
FIG. 7 is a schematic plan view of a Y-type intersection with the trolley being turned to the left.

FIG. 7 illustrates a 3-way or Y-type intersection which includes a single 90° curved section 50 connecting perpendicularly arranged track sections 52 and 54 which enables the trolley 20 to move to the left from track section 52 onto track section 54. Alternately, the trolley 20 can move from track section 52 to track section 56 through a 45° angular track section 58 joined to the track section 52 by a 45° curved section 60 and joined to the track section 56 by a 45° curved section 62.

Figure 8:
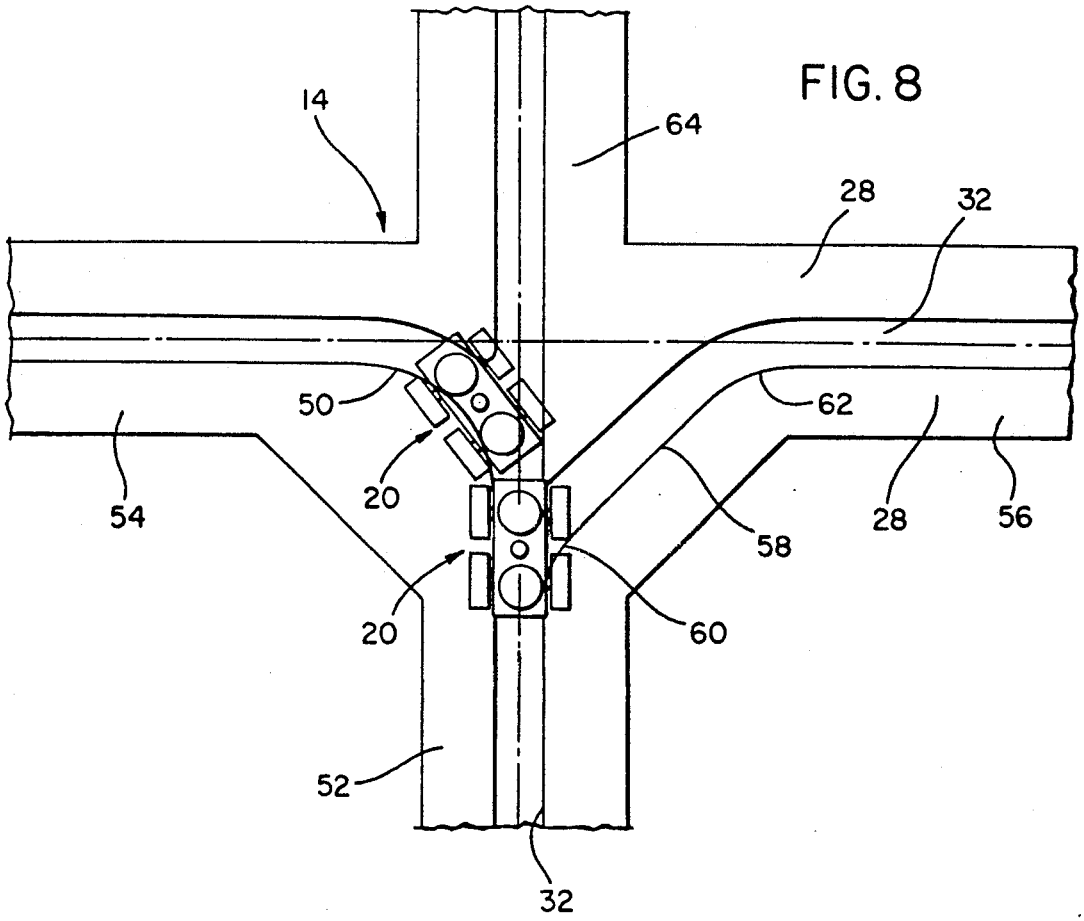
FIG. 8 is a schematic plan view illustrating a 4-way or X-type intersection with a 90° curve in one direction and two 45° curves in the opposite direction.

FIG. 8 illustrates a 4-way or X-type intersection which is generally the same as FIG. 7 except that a straight through track section 64 is in alignment with and forms a continuation of track section 52 so that a trolley can move straight through from track section 5 to track section 64 which is in alignment therewith or it can move from track section 52 onto track section 54 or onto track section 56. This arrangement combines a 90° curve with two 45° curves thereby spacing the points where the respective curves 50 and 60 intersect the track slot 32 of track segment 52, so that only one of the four trolley wheels 24 crosses the track slot 32 at any one time thus enabling the three remaining trolley wheels to support the trolley as the single wheel crosses the slot thereby enabling the trolley to cross the track slot smoothly without dropping. This feature enables a four-wheel trolley to be utilized rather than a six wheel trolley or some other more complex structure to keep the wheels from dropping into the track slot 32 as the trolley traverses the crossover. Six-wheel trolleys are very difficult to force through a multidirectional intersection because of the additional axle spacing. By enabling the use of a four-wheel trolley, the axle spacing can be reduced with the closer axle spacing requiring less force to cause the trolley to follow the curves of the track. The two 45° curves 60 and 62 and the 90° curve 50 in FIG. 8 allows opposite direction track section center lines to cross each other from a single point at the center of the intersection with the opposite track sections 54 and 56 not only being parallel but also in alignment to provide a compact intersection.

Thus, the combination of the rigid carrier plate, frame or other generally rectangular trolley body 22 with the four radial wheels mounted in closely spaced relation to each other on the trolley plate 22 together with longitudinally spaced apart curves 50 and 60 eliminates the problem of existing structures in which the trolley or carriage wheels or rollers drop into a track slot.

Figure 9:
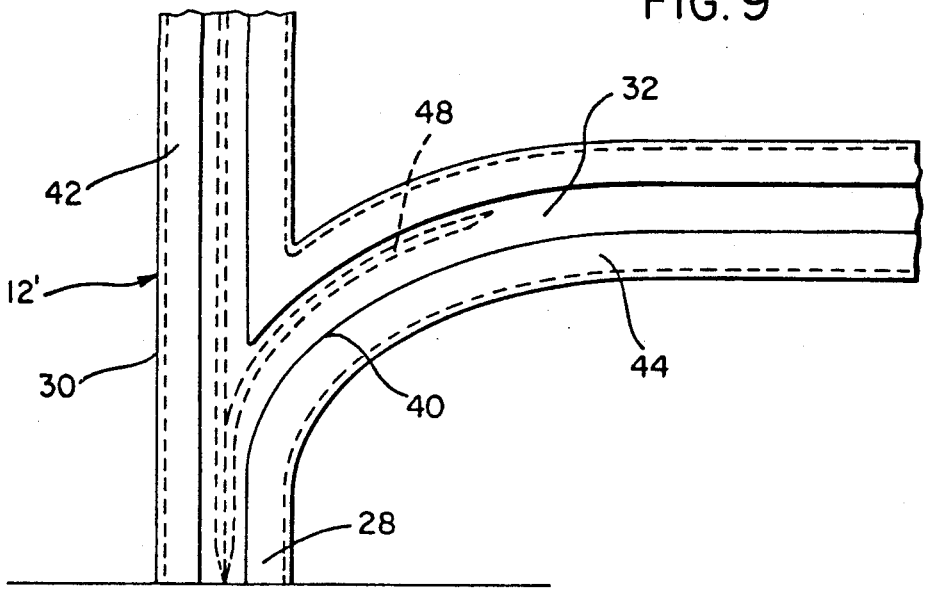
FIG. 9 is a bottom schematic view of a track intersection with diverter blades associated therewith.
Figure 10:
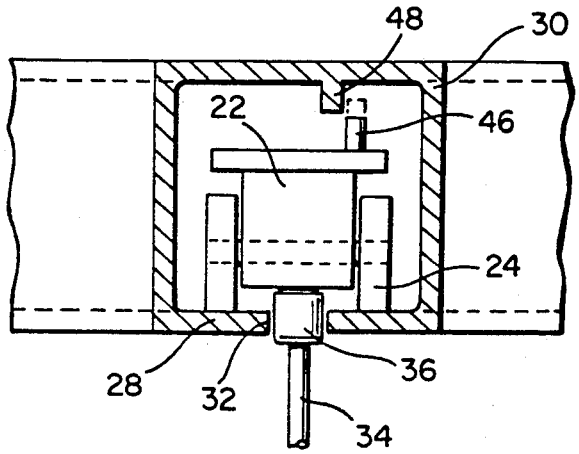
FIG. 10 is a sectional view illustrating the relationship of the trolley, diverter pins and diverter blades.
Figure 11:
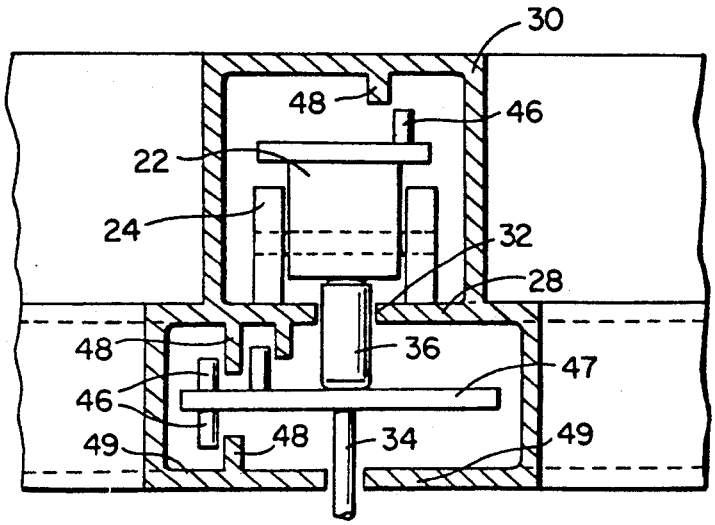
FIG. 11 is a sectional view similar to FIG. 10 with the addition of lower diverter pins and blades.

When combining the multi-directional track and trolley system with the preprogrammed track and trolley system, the trolley plate 22 will be provided with upstanding diverter pins 46 at opposite ends thereof with the diverter pins being oriented at selected positions on the trolley plate 22 to engage depending diverter blades 48 associated with one or more diverter intersections as shown in FIGS. 9–11. Further, as shown in FIG. 10, depending upon the position and length of the pins 46 on the trolley and the positioning and vertical height of the diverter blade or blades 48, the trolley 20 will follow a predetermined route along the overhead track system thereby eliminating the possibility of a panel 18 being moved to an erroneous position. The diverter pins 46 can be long or short to cooperate with tall or short blades and can be oriented at different positions on the trolley. The variation in length of the pins 46 and height of the blades 48 is illustrated by dotted line in FIG. 10. FIG. 11 illustrates an arrangement in which the trolley has a depending pin support 47 having upwardly and/or downwardly projecting pins 46 thereon to cooperate with depending and/or upstanding blades 48 supported from depending supports 49 on the track. The pins 46 are preferably provided with rotatable sleeves journaled thereon to reduce frictional drag when the pins engage the diverter blades 48. Various combinations of movement may be employed to preprogram the movement of the panels with a lead trolley on a panel and the rear trolley on a panel not necessarily following the same path, for example, with the lead trolley going straight and the rear trolley going left as occurs in the stacking area in FIG. 1.

Combining the beneficial features of a multi-directional trolley track system and the preprogrammed trolley track system enables the movable wall panels, for example, to be easily stored in a preprogrammed area and enables the same panels to assume wall forming position in two or more different areas without the use of track switching stations.

Depending on the diverter blade position on successive diverter intersections and the position of the diverter pins on the trolley, the trolley will always follow the same route along an overhead track system except when manually directed at a multidirectional track intersection. The depending guide rollers on the bottom front and back of a four radial wheel trolley enable side pressure exerted by the diverter pins in a preprogrammed system to cause the trolley guide rollers to follow the track slot edge that it is being pushed against regardless of whether the track slot is straight or curved in either direction. This allows a track intersection without diverter blades to be multidirectional even though the trolley has diverter pins mounted thereon. Thus, there has been combined the easily maneuvered preprogrammed track trolley system and a multi-directional trolley track system using the advantages of both systems.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A track and trolley system for movably supporting wall panels, said track including spaced track flanges defining a track slot, said trolley including four radial wheels mounted in laterally spaced tandem pairs on a rigid trolley body for rotation about parallel horizontal axes, said wheels rollingly engaging said track flanges, a supporting member extending through said track slot and connecting said trolley with a panel, said track including at least one track intersection, characterized in that said trolley upon entering said intersection from at least one direction can exit said intersection in any of at least two directions without stopping.

2. The structure as defined in claim 1 characterized in that a change in the direction of travel of said trolley is accompanied by a corresponding rotation of said trolley about a vertical axis.

3. The structure as defined in claim 2 characterized in that said track intersection includes at least two intersecting straight track portions interconnected by a connecting track portion, said connecting track portion including at least one curved track element.

4. The structure as defined in claim 3 characterized in that the rotation of said trolley is comprised of an initial manual partial rotation, caused by application of lateral manual force to said panel, followed by automatic rotation caused by cooperation between said trolley and said connecting track portion.

5. The structure as defined in claim 4 characterized in that said manual partial rotation is on the order of 30°.

6. The structure as defined in claim 5 characterized in that at said track intersection said trolley rotates and changes its direction of travel by a total of 90° of which said automatic rotation is on the order of 60°.

7. The structure as defined in claim 4 characterized in that said trolley includes guide means for guiding engagement with said curved track element.

8. The structure as defined in claim 7 characterized in that said curved track element is comprised of a track flange portion having a curved track flange edge and said guide means extends into said track slot for engaging said curved track flange edge.

9. The structure as defined in claim 8 characterized in that said guide means includes a pair of longitudinally spaced guide rollers rotatable about vertical axes, said supporting member being disposed between said guide rollers, the distance between and the outside diameter of said guide rollers and the radius of said curved track flange edge being dimensioned to maintain said supporting member in spaced relation to said curved track flange edge thereby enabling the lead guide roller to follow said curved track flange edge due to lateral force exerted on said trolley during initial movement into said track connecting portion with the remaining movement of said trolley through said intersection being automatically guided as said guide rollers follow the track slot in said track connecting portion.

10. The structure as defined in claim 9 characterized in that the radius of said curved track flange edge is approximated by the following formula:

$$r \geqq \frac{(D_1 - D_2)^2 + l^2}{4(D_1 - D_2)}$$

wherein r is the radius of said curved track flange edge, $D_1$ is the diameter of each of said guide rollers, $D_2$ is the diameter of said supporting member and l is the distance between the axes of said guide rollers.

11. The structure as defined in claim 1 characterized in that said trolley upon entering said intersection from at least one direction can exit said intersection in any of three directions without stopping.

12. The structure as defined in claim 11 characterized in that said track intersection is an X-intersection comprised of a straight through track together with right hand and left hand branch tracks that are aligned with each other and perpendicular to said through track, each branch track being connected to said through track by a connecting track portion such that the respective connecting track portions intersect said through track on opposite sides and at points longitudinally spaced along said through track thereby avoiding transverse alignment of openings in the track flanges of said through track and precluding vertical movement of said trolley as it traverses said intersection in a straight through direction or in either branch direction with three of the four wheels on said trolley always being in supporting engagement with said track flanges.

13. The structure as defined in claim 12 characterized in that one of said connecting track portions includes a 90° curved track element and the other of said connecting track portions includes a pair of spaced 45° curved track elements to facilitate alignment of said branch tracks with each other and the longitudinal spacing of the points of intersection of said respective connecting track portions with said through track.

14. The structure as defined in claim 1 characterized in that said track intersection is a Y-intersection comprised of a straight approach track together with right hand and left hand branch tracks that are aligned with each other and perpendicular to said approach track, each branch track being connected to said approach track by a connecting track portion such that the respective connecting track portions join said approach track at points longitudinally spaced along said approach track, one of said connecting track portions including a 90° curved track element and the other of said connecting track portions including a pair of spaced 45° curved track elements to facilitate alignment of said branch tracks with each other.

15. The structure as defined in claim 14 characterized in that said trolley does not require the application of lateral manual force to said panel in order to rotate and change its direction of travel at said 90° curved track element but does require the application of lateral manual force to said panel in order to rotate and change its direction of travel at the first of said 45° curved track elements.

16. The structure as defined in claim 1 characterized in that in addition to said track intersection the track includes at least one diverter intersection in which said trolley upon entering said diverter. intersection from any direction can exit said diverter intersection in only one direction without reversing its direction of travel.

17. The structure as defined in claim 16 characterized in that said diverter intersection includes a track diverter element mounted rigidly thereon and said trolley includes trolley diverter means engaging said track diverter element for controlling directional movement of said trolley through said diverter intersection.

18. The structure as defined in claim 17 characterized in that said track diverter element is a straight line element when said trolley is controlled to move straight through said diverter intersection.

19. The structure as defined in claim 17 characterized in that said track diverter element is a curved line element when said trolley is controlled to change its direction of travel at said diverter intersection.

20. The structure as defined in claim 17 characterized in that said track diverter element is in the form of a longitudinally extending straight or curved vertical blade.

21. The structure as defined in claim 17 characterized in that said trolley diverter means is in the form of a pair of longitudinally spaced vertically extending pins or rollers.

22. The structure as defined in claim 17 characterized in that said trolley diverter means may be located along, or laterally spaced on either side of, the longitudinal centerline of said trolley for engaging correspondingly positioned track diverter elements.

23. The structure as defined in claim 22 characterized in that said trolley diverter means may be located above or below said trolley body for engaging correspondingly positioned track diverter elements.

24. The structure as defined in claim 23 characterized in that said trolley diverter means when located below said trolley body may extend upwards or downwards.

25. The structure as defined in claim 23 characterized in that said trolley diverter means may be tall or short and said track diverter elements may be tall or short such that tall trolley diverter means will engage tall or short track diverter elements while short trolley diverter means will engage tall, but not engage short, track diverter elements.

26. The structure as defined in claim 17 characterized in that said track and trolley system has supported therefrom a plurality of panels, each panel being supported from said track by two trolleys, said system including one or more of said track intersections and one or more of said diverter intersections, each of the trolleys in said system including said trolley diverter means so that each trolley upon entering a track intersection can be selectively caused to exit such track intersection in either of at least two directions without stopping and upon entering a diverter intersection can exit such diverter intersection in only one direction without reversing its direction of travel, thereby providing a track and trolley system having a combination of one or more multi-directional track intersections offering directional selectivity with one or more diverter intersections offering pre-programmed directional control.

27. The structure as defined in claim 1 characterized in that said track and trolley system has supported therefrom a plurality of panels, each panel being supported from said track by two trolleys, said track intersection being in the form of a dual purpose track/diverter intersection incorporating a track diverter element mounted rigidly thereon, some of the trolleys in said system including trolley diverter means that engage said track diverter element for preprogrammed directional control of such trolleys through said intersection while other trolleys in said system either do not include trolley diverter means or include trolley diverter means configured to not engage said track diverter element so that such trolleys can be selectively directed in multidirections through said intersection.

* * * * *